US007140970B1

(12) United States Patent
Fossa

(10) Patent No.: US 7,140,970 B1
(45) Date of Patent: Nov. 28, 2006

(54) TABLE BOWLING GAME

(75) Inventor: Edwin V. Fossa, Westerville, OH (US)

(73) Assignees: Beverly DeMario, Hubbard, OH (US); Elaine Loeffert, Westerville, OH (US)

( * ) Notice: Subject to any disclaimer, the term of this patent is extended or adjusted under 35 U.S.C. 154(b) by 72 days.

(21) Appl. No.: 11/057,672

(22) Filed: Feb. 15, 2005

(51) Int. Cl.
*A63D 3/00* (2006.01)

(52) U.S. Cl. ..... 473/116; 273/108.56; 273/119 R

(58) Field of Classification Search ..... 473/45, 473/116; 273/317.7, 108.31, 108.56, 119 R, 273/129 R, 125 T
See application file for complete search history.

(56) References Cited

U.S. PATENT DOCUMENTS 1,326,071 A * 12/1919 Lloyd ..... 473/82
1,919,094 A * 7/1933 Cuchran ..... 473/107
2,204,473 A * 6/1940 Colaluca ..... 473/116
2,720,398 A * 10/1955 Andrews et al. ..... 273/126 R
2,760,776 A * 8/1956 Tullio ..... 273/317.5
3,857,562 A 12/1974 Rardon et al.
5,096,192 A * 3/1992 Stanford, Jr. ..... 473/109
5,655,768 A 8/1997 Moret et al.
5,785,313 A * 7/1998 Shiraishi ..... 273/108.1
6,319,144 B1 11/2001 Hasty
2002/0163130 A1 11/2002 Kornafel

* cited by examiner

*Primary Examiner*—William M. Pierce
(74) *Attorney, Agent, or Firm*—Harpman & Harpman

(57) ABSTRACT

A bowling game table having a game lane surface with oppositely disposed ball return gutters, multiple ball engagement shoes are movably positioned transversely at one end thereof with a plurality of pins set up at the other end thereof. An independent playing cue selectively registerable through and aligned with said ball engagement shoes. Selective ball positioning on the game lane within said ball engagement shoes before launch towards the pins by engagement with said cue.

8 Claims, 2 Drawing Sheets

TABLE BOWLING GAME

BACKGROUND OF THE INVENTION (1) Field of the Invention

This invention relates to table type miniature bowling games that provide for a bowling experience in a self-contained table apparatus.

(2) Description of Prior Art

Prior art devices of this type have been directed to a variety of bowling simulation games in which miniature bowling lanes are used with appropriate scaled down balls and pins to re-create the bowling experience, see for example U.S. Pat. Nos. 3,857,562, 5,096,192, 5,655,768, 6,319,144 and Patent Publication US 2002/0163130 A1.

In U.S. Pat. No. 3,857,562 a miniature bowling game apparatus is disclosed wherein a table top lane, pin setter and ball launcher are used to simulate regulation bowling.

U.S. Pat. No. 5,096,192 discloses a miniature bowling game having a game table with a lane, a pin setting device on one end and a ball guide and release device on the lane's remaining end. This device also includes a ball return extending below the lane surface.

A bowling toy is shown in U.S. Pat. No. 5,655,768 in which a unique ball launching and pin setting apparatus are disclosed. The ball is driven by a spinning engagement wheel. The pin setting apparatus is loaded with pins and then pivoted down into place on one end of the playing surface for pin placement.

In U.S. Pat. No. 6,319,144 a billiard bowling game is disclosed using scale down bowling lanes, balls and pins. It is directed to an automated pin setting device that cleans the lane and resets the pins for the next player similar to that found in regulation bowling alleys.

Patent Publication 2002/0163130 A1 discloses a shell and chance game that utilizes a preset arrangement of receivers at one end within a ball and ball launcher to propel a ball towards the receivers for hopeful engagement there within.

SUMMARY OF THE INVENTION

The present invention defines a self-contained scale down bowling experience utilizing miniature bowling balls and pins for use on a table lane configuration. An adjustable ball director and launcher allows handicapped individuals and the elderly to aim and roll the ball towards the pins using only arm and hand motion by gripping and pushing a drive cue. A ball containment shoe bracket within the lane area stabilizes and aligns the ball on the lane.

DETAILED DESCRIPTION OF THE INVENTION

Figure 1:
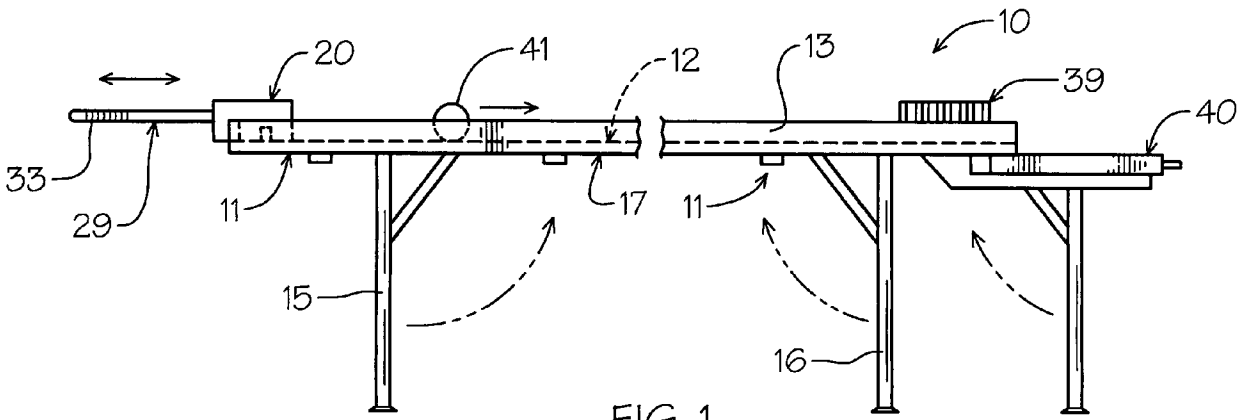
FIG. 1 is a side elevational view with portions broken away of a bowling game of the invention.
Figure 2:
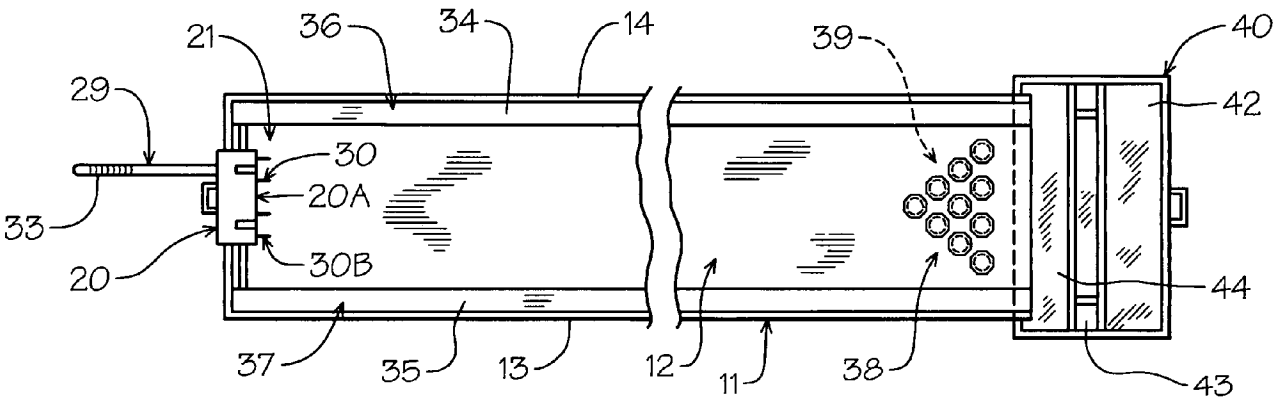
FIG. 2 is a top plan view thereof.

Referring to FIGS. 1 and 2 of the drawings, a bowling game 10 of the invention can be seen having a main support table 11 defining a game lane 12 with upstanding elongated side rails 13 and 14. Pairs of folding support legs 15 and 16 extend from the underside 17 of the table 11 as is typically known within the art.

The game lane 12 and table 11 has an end rail 18 which in combination with the side rails 13 and 14 define the length and width of the game lane 12. A ball aiming and launching device 20 is removably positioned on one end 21 of the game lane 12 having a main body member 22. A guide rail 23 extends transversely across the game lane 12 in spaced parallel relation to said end rail 18 which together form guide tracks 24 for the main body member 22. A pair of guide channels 25 and 26 are formed on the undersides of the main body member 22 and are registerable with the hereinbefore described end and guide rails 18 and 23 respectively as shown in dotted lines in FIG. 3 and solid lines in FIG. 4 of the drawings.

The alignment and launching device 20 of the game has a pair of guide bores at 27 and 28 extending transversely therethrough which through which a slidably positioned corresponding ball cue 29 can be selectively positioned therein. Ball engagement shoes 30A and 30B are secured to a front surface 20A of the launching device 20 extending into the game lane 12. The ball shoes 30A and 30B are identical having a back plate 31 with spaced opposing side plates 32 extending at right angles therefrom.

Figure 3:
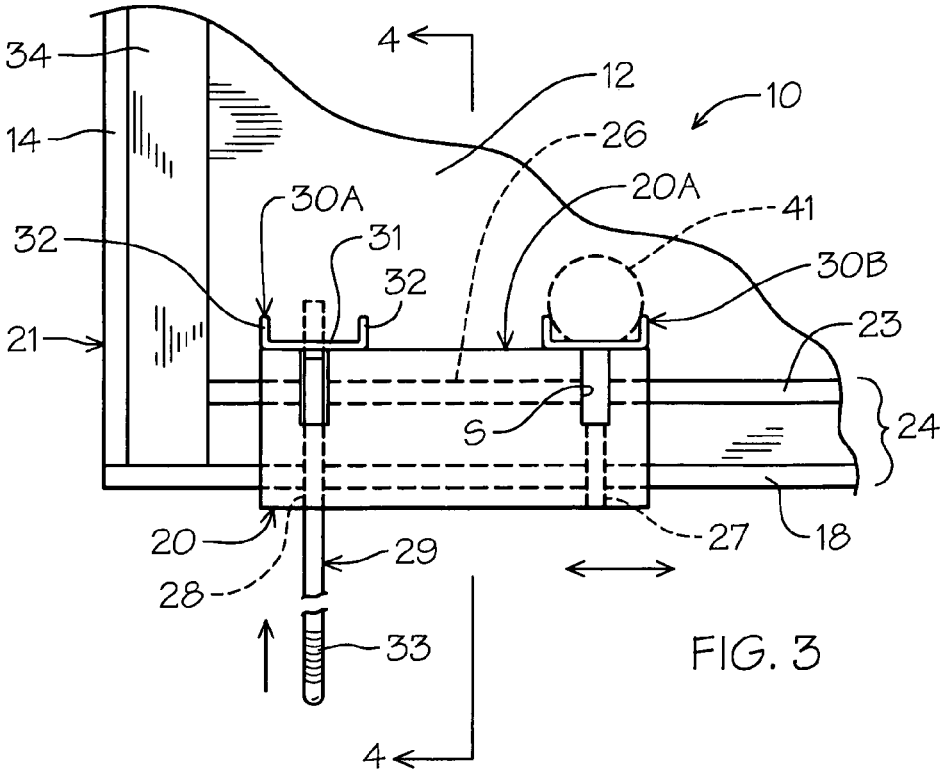
FIG. 3 is an enlarged partial top plan view of a ball aiming and launching device of the invention.

The ball cue 29 is extended selectively through the guide bores 27 and 28 in the main body member 22 and define hand grip portion 33 thereon as best seen in FIG. 3 of the drawings.

A pair of viewing slots S are formed in the top surface of the alignment and launching device 20 extending inwardly from the front surface 20A and align with the respective guide bores 27 and 28 so as to allow for viewing the end of the cue 29 for striking a scaled down bowling ball 41.

It will be evident from the above description that the alignment and launching device 20 of the game can be slidably repositioned transversely along the length of the respective end and guide rails 18 and 23 by an attached handle H which will allow for full lane positioning of one or more of the other ball shoes 30A and 30B and engageable ball cue 29 as described.

The game lane 12 is further defined by a pair of parallel spaced recessed gutter surfaces 34 and 35 which extend longitudinally the length of the game lane 12 spaced inwardly from the respective side rails 13 and 14 forming ball gutters 36 and 37 thereon emulating a real bowling alley (not shown).

A pin placement area 38 in the game lane 12 is an oppositely disposed longitudinal relation to said alignment and launching device 20 of the game adjacent the end of the game lane 12. A plurality of scaled down bowling pin representations 39 are "set" thereon, again to simulate a real bowling experience. Each of the pins 39 have a multi-sided flat side surfaces 39A with a reduced diameter base 39B for lane engagement. This prevents the pins 39 from rolling excessively about the game lane 12 after they are struck during play. A pin repository and launching device storage case 40 is removably attached below the end 19 of the game lane surface 12 and acts as a pin repository during use which will be described in greater detail hereinafter.

Figure 4:
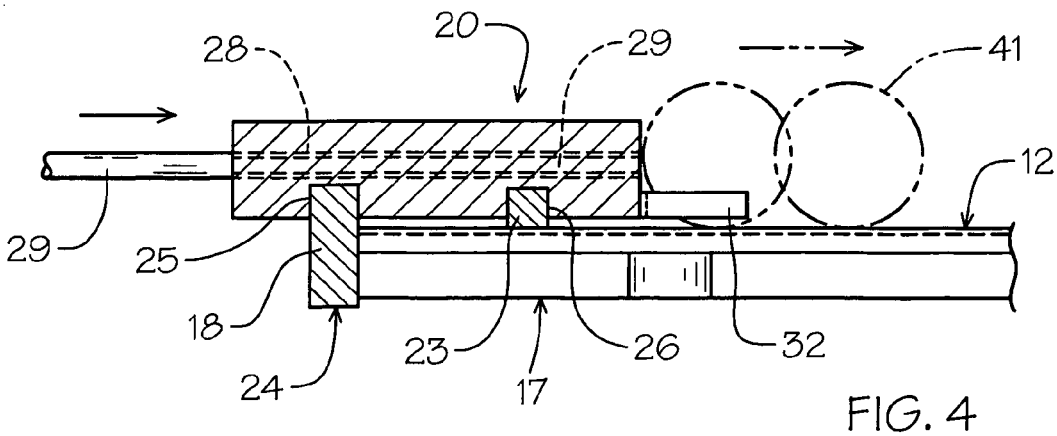
FIG. 4 is an enlarged sectional view on lines 4—4 of FIG. 3.

In use, the scaled down bowling ball 41 of the game, shown in broken lines in FIGS. 3 and 4 of the drawings, is positioned within either of the respective ball shoes 30A or 30B. Ball placement depends on where the alignment and launch device 20 of the game has been positioned by the player, (not shown) along the guide rails 18 and 23 to line up for the next "roll" of the bowling ball 41. The hand grip portion 33 of the cue 29 is then grasped by the player to strike the bowling ball 41 positioned within the respective ball shoe as down the game lane 12 towards the pins 39 within the pin placement area 38 as hereinbefore described.

The ball gutters 36 and 37 on either side of the game lane 12 are used to retrieve the bowling ball 41 back to the alignment and launching device 20 of the game for reuse. Alternately, just as in real bowling an errant ball "roll" will deposit the bowling ball 41 into the respective gutters 36 and 37, although by use of the alignment and launching device 20 of the game there is less likelihood of doing so.

The storage case 40 is divided up into multiple receiving areas 42, 43, and 44 for the respective pins 39, ball 41, cues 29 and alignment and launching device 20.

It will be evident that due to the relative height of the game table 11, it allows individuals in wheelchairs to easily play the game. Also by directing the bowling ball 41 by use of the cue 29 and ball shoes 30A and 30B diminished physical ability will not prevent the participation by potential users in the game.

It will thus be seen that a new and novel bowling ball game has been illustrated and described and it will be obvious to those skilled in the art that various changes and modifications may be made therein without departing from the spirit of the invention.

I claim:

1. A bowling game comprises, a rectangular game lane surface having opposing upstanding side rails, upstanding end rail and support legs extending therefrom, a ball alignment and launching assembly slidably positioned on said end rail, a pin placement area on said game lane surface in oppositely disposed relation to said end rail, bowling pins arranged in said pin placement area, said ball alignment and launching assembly comprising, at least one ball engagement shoe extending from said launching assembly, a ball engagement cue selectively and removably positioned through guide bores in said launching assembly guide channels in said launching assembly for adjustably repositioning said ball alignment and launching assembly transversely between said side rails, a ball positioned within said ball engagement shoe to be launched so as to roll on said game lane towards said arranged bowling pins, pin reposition and transportation means selectively secured at the open end of said game lane below said game lane's surface and means for returning said bowling ball to said ball alignment and launching assembly.

2. The bowling ball game set forth in claim 1 wherein said game lane defines a self-supporting table having multiple legs extending therefrom.

3. The bowling game set forth in claim 1 wherein said rectangular game lane surface is substantially flat.

4. The bowling game set forth in claim 1 wherein said respective ball alignment and launching assembly further comprises a main body member, elongated multiple bores extending transversely therethrough for removable registering of said ball engagement cue therein.

5. The bowling game set forth in claim 1 wherein said ball engagement shoe is of a known internal dimension greater than that of said ball to be positioned rollably therein.

6. The bowling game set forth in claim 1 wherein said said ball alignment and launching assembly is transversely movable between said respective side rails further comprises, a guide track in parallel spaced relation to said end rail on said game lane surface.

7. The bowling game as set forth in claim 1 wherein said pin reposition and transportation means comprises, a storage case having multiple components to receive said pins, said ball engagement cue and said ball alignment and launching assembly.

8. The bowling game as set forth in claim 1 wherein said means for returning said bowling ball to said ball alignment and launching assembly of said game lane comprises, a pair of ball return gutters extending in spaced parallel relation to said respective side rails with said game lane therebetween.

* * * * *